United States Patent [19]

Powell

[11] Patent Number: 4,945,700

[45] Date of Patent: Aug. 7, 1990

[54] TOOL AND METHODOLOGY FOR PATCHING WALLBOARD

[76] Inventor: Wayne T. Powell, P.O. Box 3934, San Clemente, Calif. 92672

[21] Appl. No.: 408,181

[22] Filed: Sep. 12, 1989

[51] Int. Cl.[5] ..... E02G 23/00

[52] U.S. Cl. ..... 52/514; 411/388

[58] Field of Search ..... 52/514; 411/388

[56] References Cited

U.S. PATENT DOCUMENTS 3,690,084 9/1972 Leblanc ..... 52/514

4,811,531 3/1989 Vallerand ..... 52/514 X

FOREIGN PATENT DOCUMENTS 654181 6/1951 United Kingdom ..... 411/388

*Primary Examiner*—David A. Scherbel

*Assistant Examiner*—Creighton Smith

[57] ABSTRACT

A device includes a shaft having first and second ends and a length between the first and second ends sufficient to span an airspace between first and second wallboards mounted on a wall framework. First and second mountings are provided for securing a separately supplied patch to the first end of the shaft and the second end of the shaft to the second wallboard in order to support the patch in a hole in the first wallboard. A method of patching a hole in a wallboard includes providing a device as described above, securing a patch to the first end of the shaft and securing the second end of the shaft to the second wallboard so that the patch is in the hole in the first wallboard.

10 Claims, 1 Drawing Sheet

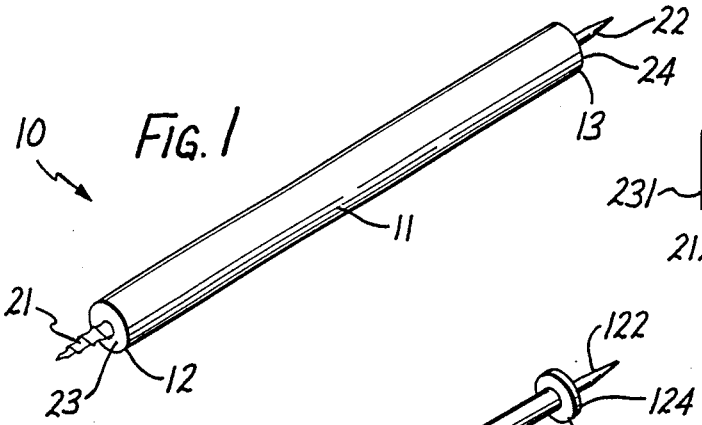
FIG. 1
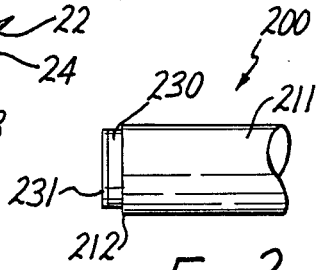
FIG. 3
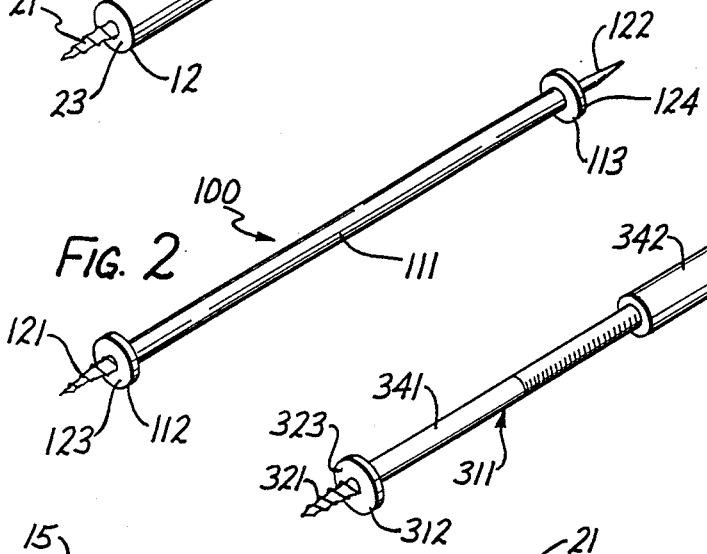
FIG. 2
FIG. 4
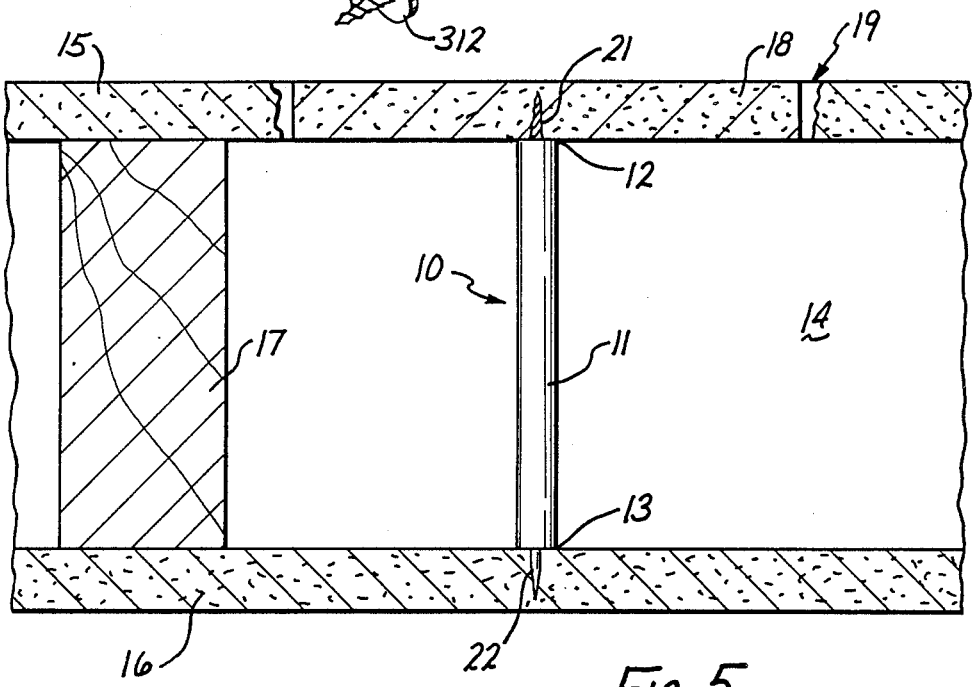
FIG. 5

TOOL AND METHODOLOGY FOR PATCHING WALLBOARD

BACKGROUND OF THE INVENTION

1. Technical Field

This invention relates generally to the wallboard used in constructing buildings, and more particularly to a tool and related methodology for patching a hole in such wallboard.

2. Background Information

Patching a hole in installed wallboard usually involves filling the hole with some sort of spreadable patching compound, letting the compound dry, and then sanding it so that it blends in with the original wallboard. If the hole is large enough, one might cut an extra piece of the wallboard into a patch that fills the major portion of the hole and then use the patching compound to finish the job. However, wallboard installations often include an airspace behind the wallboard that can frustrate patching efforts.

Consider a typical wall structure, for example. It may include two wallboards on opposite sides of a wall framework formed from two-by-four or two-by-six studs, the term "wallboard" including any of various types of drywall, sheetrock, and plaster-type wallboard used to construct such structures as walls and ceilings. The outer surface of one wallboard faces one room of the house, the outer surface of the other wallboard faces an adjacent room, and the interior surfaces of the two wallboards face each other, separated by an airspace of approximately 3½ inches or 5½ inches depending on the size of the studs. As a result, the patch and patching compound can fall out of the hole being patched into the airspace, thereby complicating the patching task.

Attempts at overcoming that problem may include such expedients as stuffing the airspace with newspaper as a backing, framing in a portion of the airspace, and cutting the patch in a way creating overhangs that tend to inhibit the patch from falling into the airspace. However, those techniques can be time-consuming, relatively costly, and even ineffective. Consequently, it is desirable to have a better way of patching a hole in wallboard.

SUMMARY OF THE INVENTION

This invention solves the problems outlined above by supporting the patch in the hole with a device that extends across the air space to the opposite wallboard. Thus, the device can be conveniently installed by inserting it through the hole that is to be patched. There, it is screwed or driven into, or stuck onto, the opposite wallboard to firmly hold the patch in place in the hole to be patched so that the patch and the patching compound do not fall into the airspace. In addition, the device can be inexpensively fabricated in various sizes suitable for the differently sized airspaces of different frameworks.

Generally, a device constructed according to the invention includes a shaft having first and second ends and a length between the first and second ends sufficient to span an airspace between first and second wallboards mounted on a wall framework. First mounting means are provided for securing a separately supplied patch to the first end of the shaft, as well as second mounting means for securing the second end of the shaft to the second wallboard in order to support the patch in a hole in the first wallboard.

At least one of the first and second mounting means may include a screw member so that it can be screwed into the patch or wallboard. The other one can be configured the same way or it may include a nail member so that it can be driven into the patch or wallboard like a nail. In one embodiment, the shaft is something like the shaft of a nail supplied with two heads, the first and second mounting means being integrally attached to the two heads in one-piece construction. In another embodiment, the shaft is composed of a thermoplastic material, the first and second mounting means being separate components imbedded in opposite ends of the shaft. In addition, the shaft may be adjustable and one or both of the mounting means may include an adhesive instead of the screw and nail.

In line with the above, a method of patching a hole in a first one of first and second wallboards mounted on a framework includes the steps of providing a device as previously described and a patch dimensioned and arranged to fill a portion of the hole. The method proceeds by securing the patch to the first end of the shaft and securing the second end of the shaft to the second wallboard so that the patch is in the hole in the first wallboard. The step of securing the second end of the shaft to the second wallboard can be performed before the step of securing the patch to the first end of the shaft. Depending on circumstances, one end might be screwed into the patch first and then the other end driven into the second wallboard. Or one end might be screwed into the other wallboard first and then the patch pressed onto the other end to drive the nail member into the patch. In any event, a firmly supported patch results.

The foregoing and other objects and features of the invention and the manner of attaining them will become apparent and the invention itself will be best understood by reference to the following description taken in conjunction with the accompanying illustrative drawings.

BRIEF DESCRIPTION OF THE DRAWINGS

FIG. 1 of the drawings is a perspective view of a first embodiment of a device constructed according to the invention that has a screw member and a nail member embedded in opposite ends of a thermoplastic shaft;

FIG. 2 is a perspective view of a second embodiment that has a nail-like shaft;

FIG. 3 is an enlarged view of a portion of a third embodiment that uses adhesive mounting means;

FIG. 4 is an enlarged view of a portion of a fourth embodiment having an adjustable shaft; and FIG. 5 is a cross sectional view of a wall showing the device spanning the airspace between two wallboards mounted on a two-by-four framework where the device supports a patch in a hole in the first wallboard.

DESCRIPTION OF THE PREFERRED EMBODIMENTS

Referring now to the drawings, their is shown a device 10 constructed according to the invention (FIGS. 1 and 5). Generally, the device 10 includes a shaft 11 extending between first and second ends 12 and 13 of the shaft 11 (FIG. 1). In addition, the device 10 includes first and second mounting means on the shaft 11 as subsequently described.

Considering the shaft 11 first, it has a length between the first and second ends 12 and 13 sufficient to span (i.e., substantially span) an airspace that is of predetermined size such as the airspace 14 situated between first and second wallboards 15 and 16 mounted on a framework 17 (FIG. 5). For frameworks having two-by-four studs, the airspace 14 and the length of the shaft 11 is about 3½ inches, while for frameworks having two-by-six studs, the airspace 14 and the length is about 5½ inches. In addition, the first and second wallboards 15 and 16 may commonly be ⅝ inch or ¾ inch thick, and it is intended that FIG. 5 serve as an illustration for all those variations in the framework and wallboards. The device 10 can, of course, be fabricated so that the length of the shaft 11 enables use when the framework has some other size, but 3½ inches and 5½ inches are most common.

In line with the above, the word "shaft" is intended to refer broadly to any member having first and second ends and a length between the first and second ends sufficient to span an airspace between first and second wallboards mounted on a wall framework so that the wallboards are separated by an airspace of predetermined size. In addition, the shaft is composed at least partially of a material having sufficient rigidity to make the shaft rigid enough to support a patch in the manner described and for that purpose, the shaft 11 employs a thermoplastic material. Thus, the shaft 11 is suitably configured for use in supporting a separately supplied patch 18 in a hole 19 that is to be patched in the first wallboard 15.

In order to support the patch 18, however, the patch 18 must be secured to the shaft 11, and the shaft 11 must be secured to the second wallboard 16. For that purpose, the invention includes first mounting means for securing a separately supplied patch to the first end of the shaft, and second mounting means for securing the second end of the shaft to the second wallboard in order to support the patch in a hole in the first wallboard.

For the device 10, the first mounting means is configured so that it can be screwed into the patch or the wallboard. In other words, the device 10 includes some sort of threaded screw member 21 that can be screwed into a wallboard and therefore the patch 18. For that purpose, the screw member 21 is configured to be similar to the pointed end of a standard wood or drywall type screw, and it is suitably attached to the first end 12 of the shaft 11, such as by imbedding it in the first end 12, so that about ⅜ inch is exposed beyond the first end 12.

For the device 10, the second mounting means is configured so that it can be driven into the patch or the wallboard like a nail. In other words, the device 10 includes some sort of pointed nail member 22 that can be driven (including being pressed into) the wallboard or the patch 18. For that purpose, the nail member 22 is configured to be similar to the pointed end of a number two finish nail, and it is suitably attached to the second end 13 of the shaft 11, such as by imbedding it in the second end 13, so that about ⅜ inch is exposed beyond the second end 13.

In addition to the foregoing, the shaft 11 includes a first radially extending portion 23 located adjacent the first end 12 of the shaft 11, and a second radially extending member 24 located adjacent the second end 13 of the shaft 11. The first radially extending portion 12 extends radially outwardly more than the screw member 21 in order to abut the patch 18 when the patch 18 is secured to the shaft 11. Similarly, the second radially extending portion 24 extends radially outwardly more than the nail member 22 in order to abut the wallboard 16 when the shaft 11 is secured to the wallboard 16. The first and second radially extending portions 23 and 24 serve as stops that prevent the screw member 21 and the nail member 22 from entering the patch 18 and the wallboard 16 more than a fixed distance (e.g., ⅜ inch for the device 10).

In order to use the device 10, the user provides a patch (e.g., the patch 18), which may be an extra piece of wallboard or other material cut to fit in the hole 19 that is to be patched. Usually the patch is cut so that it fills a major portion of the hole 19. Next, using a device such as the device 10, the user secures the patch 18 to the first end 12 of the shaft 11 and the second end 13 of the shaft 11 to the second wallboard 16 so that the patch 18 is thereby supported in the hole 19 in the first wallboard 15. Then, patching compound is applied in the usual way.

Of course, the orientation of the device 10 can be reversed so that the patch 18 is secured to the second end 13, the first end 12 then being secured to the second wallboard 16. The user may, for example, first insert the device 10 through the hole 19 and screw the first end 12 into the second wallboard 16. After that is done, the user moves the patch 18 toward the hole 19, pressing the nail member 22 into the patch 18 in order to secure the patch 18 to the second end 13. In other words, the step of securing the second end of the shaft to the second wallboard is performed before the step of securing the patch to the first end of the shaft.

Considering now FIG. 2, there is shown a second embodiment or device 100 constructed according to the invention. It is generally similar to the device 10 in many respects so that only differences are described in further detail. For convenience, reference numerals designating parts of the device 100 are increased by one hundred over those designating corresponding parts of the device 10.

Like the device 10, the device 100 includes a shaft 111 and first and second mounting means in the form of a screw member 121 attached to a first end 112 of the shaft 111 and a nail member 122 attached to a second end 113 of the shaft 111. Unlike the device 10, however, the device 100 employs unitary one-piece construction, being formed like a nail from a metal alloy such as steel to include two heads 123 and 124 that serve as first and second radially extending portions of the shaft 111, a screw portion 121 that serves as the first mounting means, and a nail portion 122 that serves as the second mounting means.

Considering now FIG. 3, there is shown an enlarged portion of a third embodiment or device 200 constructed according to the invention. It is generally similar to the device 10 in many respects so that only differences are described in further detail. For convenience, reference numerals designating parts of the device 200 are increased by two hundred over those designating corresponding parts of the device 10.

Like the device 10, the device 200 includes a shaft 211 and first and second mounting means, preferably composed of a body of thermoplastic material that is dimensioned and arranged like the shaft 11. But unlike the device 10, the device 200 the first and second mounting means are in the form of an adhesive. Both the first and second mounting means are generally similar so that only the first mounting means is described in further detail.

It includes an adhesive material 230 attached to the first end 212 of the shaft 211 and a protective cover sheet or backing sheet 231 over the adhesive material 230. Those components employ known materials and techniques so that the user can simply tear off the backing sheet 231 and press the adhesive material 230 against the patch 18 to secure the patch 18 to the shaft 211 or against the second wallboard 16 to secure the shaft 211 to the second wallboard 16. The second mounting means may include similar components attached to the second end of the shaft 211 (not shown). In other words, a known type of adhesive material is affixed to each end of the shaft 211 in such a way that the user removes a strip from each end to expose the adhesive material, pressing the exposed adhesive on one end of the shaft against the patch 18 and that on the other end of the shaft against the second wallboard 16.

Considering the mounting means employed for the devices 10 and 100 in further detail, in addition to a screw or nail member, one or both of the first and second mounting means can take any of various other forms within the broader inventive concepts disclosed, including, for example, the adhesive member used for the device 200. Although the devices illustrated in FIGS. 1 and 2 include a screw member at one end and a nail member at the other end, each is intended to serve as well as an illustration of a device having a screw member at both ends and a device having a nail member at both ends.

Similarly, the device illustrated in FIG. 3 is intended to serve as well as an illustration of a device having an adhesive member at both ends, a device having an adhesive member at one end and a screw member at the other end, and a device having an adhesive member at one end and a nail member at the other end.

FIG. 4 shows a fourth embodiment or device 300 that has an adjustable shaft 311. In other words, the length of the shaft between the first and second ends 312 and 313 of the shaft 311 can be adjusted to enable use with different sized airspaces. Otherwise, the device 300 is generally similar to the device 100, and reference numerals are increased by three hundred over those designating corresponding parts of the device 10. The adjustable shaft 311 can take any of various known forms. Preferably, it includes a first threaded section 341 that can be screwed a selected amount into a second threaded section 342 order to adjust the length of the shaft 311 according to the size of the airspace 14 (i.e., the distance between the first and second wallboards 15 and 16).

Thus, the invention can be conveniently installed by inserting it through the hole that is to be patched. There, it is screwed or driven into, or stuck onto, the opposite wallboard to firmly hold the patch in place in the hole to be patched so that the patch and the patching compound do not fall into the airspace. In addition, the device can be inexpensively fabricated in various sizes suitable for the differently sized airspaces of different frameworks.

Although an exemplary embodiment of the invention has been shown and described, many changes, modifications, and substitutions may be made by one having ordinary skill in the art without necessarily departing from the spirit and scope of the invention.

What is claimed is:

1. A device, comprising:

a shaft having first and second ends and a length between the first and second ends sufficient to span an airspace between first and second wallboards that are mounted on a wall framework so that they are separated by an airspace of predetermined size;

first mounting means for securing a separately supplied patch to the first end of the shaft; and second mounting means for securing the second end of the shaft to the second wallboard in order to support the patch in a hole in the first wallboard;

wherein the first and second mounting means are integrally attached to the shaft in one-piece construction.

2. A device as recited in claim 1 wherein at least one of the first and second mounting means is configured so that it can be screwed into the patch or wallboard.

3. A device as recited in claim 1 wherein at least one of the first and second mounting means is configured so that it can be driven into the patch or wallboard like a nail.

4. A device as recited in claim 1, wherein the device is composed of a metal alloy.

5. A device as recited in claim 1, wherein the shaft is composed of a thermoplastic material.

6. A device as recited in claim 1, wherein the first mounting means includes a screw member attached to the first end of the shaft and the second mounting means includes a nail member attached to the second end of the shaft.

7. A device as recited in claim 1, further comprising:

a first radially extending portion of the shaft located adjacent the first end of the shaft, which first radially extending portion extends radially outwardly more than the first mounting means in order to abut the patch when the patch is mounted on the shaft with the first mounting means.

8. A device as recited in claim 7, further comprising:

a second radially extending portion of the shaft located adjacent the second end of the shaft, which second radially extending portion extends radially outwardly more than the second mounting means in order to abut the wallboard when the shaft is mounted on the wallboard with the second mounting means.

9. A device as recited in claim 1, wherein the length of the shaft is adjustable.

10. A device, comprising:

a shaft having first and second ends, a first radially extending portion at the first end, a second radially extending portion located at the second end, and a length between the first and second ends sufficient to span an airspace between first and second wallboards mounted on a wall framework;

means defining a screw member integrally attached in one-piece construction to a first end of the shaft for securing a separately supplied patch to the shaft; and means defining a nail member integrally attached in one-piece construction to a second end of the shaft for securing the second end of the shaft to the first wallboard so that the patch is supported in a hole to be patched in the first wallboard.

* * * * *